US008254799B2

(12) United States Patent
Fukuhara

(10) Patent No.: US 8,254,799 B2
(45) Date of Patent: Aug. 28, 2012

(54) IMAGE FORMING APPARATUS INCLUDING A CONTROL SECTION TO CONTROL THE APPLICATION OF A CURRENT

(75) Inventor: Taku Fukuhara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 248 days.

(21) Appl. No.: 12/709,167

(22) Filed: Feb. 19, 2010

(65) Prior Publication Data

US 2011/0069983 A1 Mar. 24, 2011

(30) Foreign Application Priority Data

Sep. 18, 2009 (JP) ..... 2009-217261

(51) Int. Cl.
*G03G 15/16* (2006.01)

(52) U.S. Cl. ..... 399/66

(58) Field of Classification Search ..... 399/66
See application file for complete search history.

(56) References Cited

U.S. PATENT DOCUMENTS 7,162,171 B2 * 1/2007 Sugiyama ..... 399/49
2009/0225342 A1 * 9/2009 Ogasawara ..... 358/1.9

FOREIGN PATENT DOCUMENTS

JP 08-305123 A 11/1996
JP 11065322 A * 3/1999
JP 2006-053259 A 2/2006

* cited by examiner

*Primary Examiner* — Quana M Grainger

(74) *Attorney, Agent, or Firm* — Sughrue Mion, PLLC

(57) ABSTRACT

An image forming apparatus includes an image forming section forming a charged toner image on an image holding body; a transfer accepting body moving circularly on a circulation path; a transfer section which includes a current supplied member arranged opposite to the image holding body with respect to the transfer accepting body and applied with a current with polarity opposite to that of the toner image, and transfers the toner image to the transfer accepting body by applying a current to the current applied member; an unevenness detection section detecting an unevenness portion where unevenness occurs on the transfer accepting body; and a current control section controlling the applied current to the current applied member such that the current is larger while the unevenness portion detected by the unevenness detection section passes through the position than a current applied while another portion except the unevenness portion passes through the position.

7 Claims, 6 Drawing Sheets

FIG. 5

| | WHETHER OR NOT THERE IS DELETION (WHITE SPACE ON A COLORED BACKGROUND | OTHERS | DETER-MINATION |
|---|---|---|---|
| EXAMPLE | A | A | A |
| COMPARATIVE EXAMPLE 1 | F | A | F |
| COMPARATIVE EXAMPLE 2 | A | RE-TRANSFER OCCURRENCE BY REVERSLY POLARISING | F |

IMAGE FORMING APPARATUS INCLUDING A CONTROL SECTION TO CONTROL THE APPLICATION OF A CURRENT

CROSS-REFERENCE TO RELATED APPLICATION

This application is based on and claims priority under 35 U.S.C. 119 from Japanese Patent Application No. 2009-217261, filed Sep. 18, 2009.

BACKGROUND

Technical field

The present invention relates to an image forming apparatus.

SUMMARY

According to an aspect of the invention, an image forming apparatus includes:

an image holding body on whose surface an image is formed and which holds the image on the surface;

an image forming section that forms a toner image composed of charged toner on the surface of the image holding body;

a transfer accepting body to which the toner image formed on the surface of the image holding body is transferred and moves circularly;

a transfer section that includes a current supplied member which is arranged at a position opposite to the image holding body with the transfer accepting body being between the current applied member and the image holding body and which is applied with a current whose polarity is opposite to a polarity of the toner image formed on the surface of the image holding body by the image forming section, and that transfers the toner image to the transfer accepting body by applying a current to the current applied member;

an unevenness detection section that detects an unevenness portion where unevenness occurs on a surface of the transfer accepting body; and a current control section that controls the current to be applied to the current applied member while the unevenness portion detected by the unevenness detection section passes through the position such that the current is larger than a current to be applied while a portion other than the unevenness portion of the transfer accepting body passes through the position.

BRIEF DESCRIPTION OF THE DRAWINGS

An exemplary embodiment of the present invention will be described in detail based on the following figures, wherein:

FIG. 5 is a diagram illustrating an experiment result; and

DETAILED DESCRIPTION

In the following, an exemplary embodiment of an image forming apparatus according to the present invention will be explained.

Figure 1:
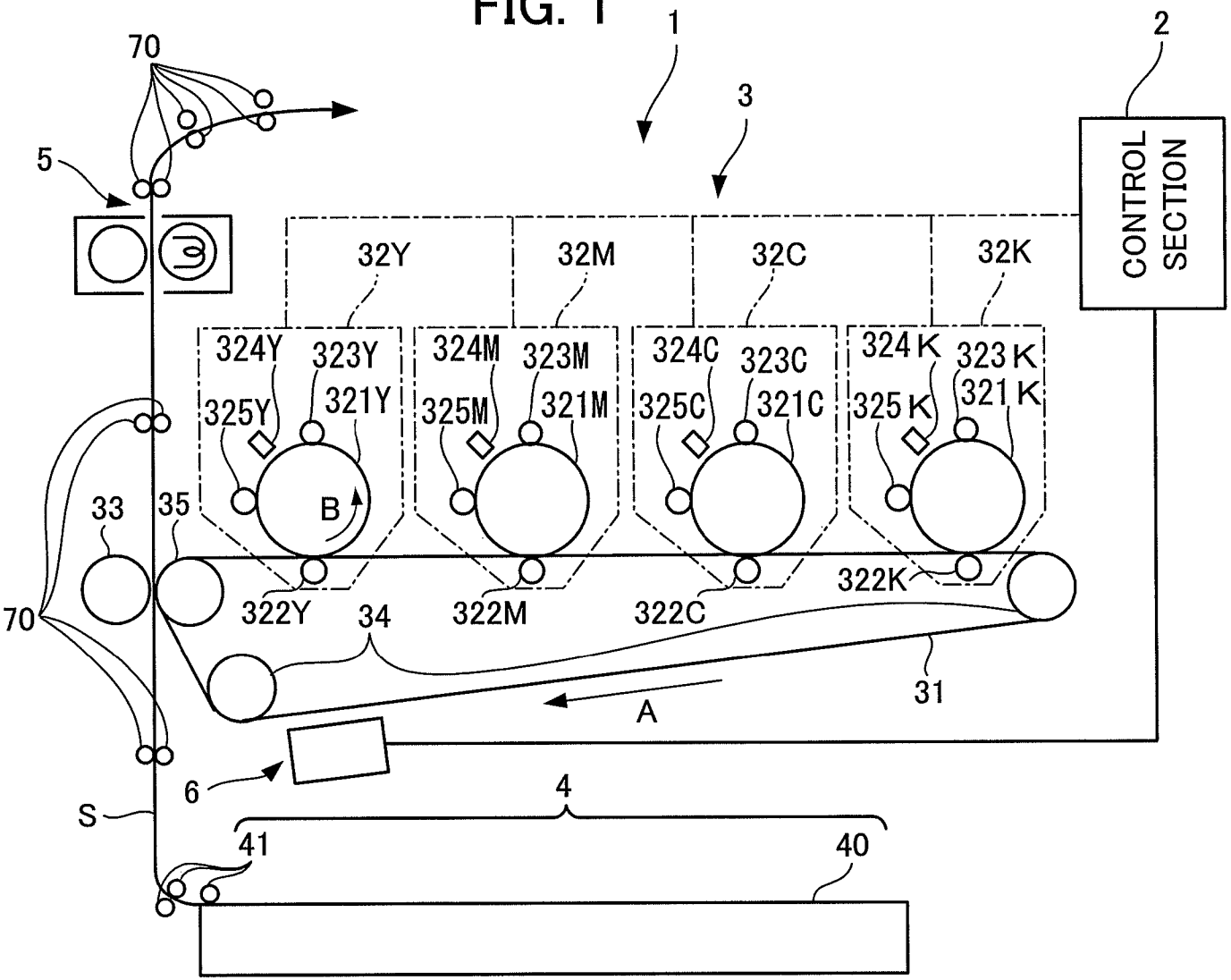
FIG. 1 is a schematic diagram of an image forming apparatus.

FIG. 1 is a schematic diagram of an image forming apparatus.

An image forming apparatus 1 illustrated in FIG. 1 is provided with a control section 2, an image forming section 3, a sheet supply section 4, an image fixing section 5 and an optical sensor section 6.

The image forming section 3 includes main bodies 32Y, 32M, 32C and 32K for respective colors of Y (yellow), M (magenta), C (cyan) and K (black), an intermediate transfer belt 31 which is put around a supporting roll 34 and a facing roll. In addition, the image forming section 3 includes a secondary transfer roll 33 to secondary transfer toner images which are accumulated and held on a surface of the intermediate transfer belt onto a recording sheet taken onto a transfer path S from a sheet storage cassette 40 by a sheet taking out roll 41. This image forming apparatus 1 is one exemplary embodiment of the image forming apparatus according to the present invention.

The main bodies of 32Y, 32M, 32C and 32K include respective photoreceptor rolls 321Y, 321M, 321C and 321K which rotate in a direction of an arrow B, respective charging devices 323Y, 323M, 323C and 323K, respective exposure devices 324Y, 324M, 324C and 324K, respective developing devices 325Y, 325M, 325C and 325K and respective primary transfer rolls 322Y, 322M, 322C and 322K. The photoreceptor rolls 321Y, 321M, 321C and 321K correspond to an example of the image holding body according to the exemplary embodiment of the invention. The charging devices 323Y, 323M, 323C and 323K, the exposure devices 324Y, 324M, 324C and 324K and the developing devices 325Y, 325M, 325C and 325K collectively correspond to an example of the image forming section according to the exemplary embodiment of the invention. The intermediate transfer belt 31 corresponds to an example of the transfer accepting body according to the present invention. In addition, the primary transfer rolls 322Y, 322M, 322C and 322K correspond to examples of the current applied member according to the present invention.

The image fixing device 5 heats and presses the recording sheet to which the toner image is secondarily transferred so as to fix the toner image on the recording sheet.

The optical sensor section 6 includes a light source to emit light toward a surface of the intermediate transfer belt 31 and a light receiving sensor to receive reflected light which is emitted from the light source and reflected on the intermediate transfer belt so as to output a signal representing light quantity of the received light.

The control section 2 controls operations of the respective sections. In addition, the control section 2 receives from the light receiving sensor which receives the reflected light emitted from the light source of the optical sensor section 6 and reflected by a patch which is a dummy of a toner image, a signal corresponding to the amount of the received right, and controls the density of the toner image.

Here, a full color image forming operation in the image forming apparatus 1 will be explained, and an operation of each section will be explained as well.

In the image forming apparatus 1, firstly, toner image forming by the main body 32Y for yellow is started, an electrical charge is given on a surface of the photoreceptor roll 321Y which rotates in the direction of the arrow B by a contact type charging device 323Y. After that, exposure light corresponding to a yellow image is emitted to a surface of a photoreceptor roll 11Y by the exposure device 324Y and an electrostatic latent image is formed. The electrostatic latent image is exposed with a yellow toner by the exposure device 325Y and a yellow toner image is formed on a surface of the photoreceptor roll 321Y. The yellow toner image formed on the surface of the photoreceptor roll 321Y is transferred by the primary transfer roll 322Y to a surface of the intermediate transfer belt 31 which is already started to rotate.

In the main body 32M for magenta, image forming timing is adjusted such that the formed magenta toner image reaches the primary transfer roll 322M, at the same time when the yellow toner image transferred to the intermediate transfer belt 31 reaches the primary transfer roll 322M. The magenta toner image is transferred to overlap the yellow toner image on the intermediate transfer belt 31 by the primary transfer roll 322M.

Subsequently, forming toner images of cyan and black by the respective main bodies 32C and 32K for cyan and black is performed at the timing similar to that described above. The formed cyan and black toner images are transferred in sequence by the respective primary transfer rolls 322C and 322K to overlap the yellow and magenta toner images on the intermediate transfer belt 31. The four color accumulated toner images which are transferred on the surface of the intermediate transfer belt 31 are transferred by the secondary transfer roll 33 onto the recording sheet which is transferred through a transfer path S by a carrying roll 70 and reaches at a secondary transfer position. The accumulated toner images which are transported onto the surface of the recording sheet are heated and pressed by the image fixing device 5 to be fixed on the recording sheet, and then the recording sheet is outputted outside by the carrying roll 70.

In the image forming apparatus 1, the photoreceptor rolls 321Y, 321M, 321C and 321K are given electrical charge of negative polarity on respective surfaces by the respective charging devices 323Y, 323M, 323C and 323K. Of the respective charged surfaces which are charged with electrical charge of the negative polarity, from respective portions to which exposure light is emitted by the respective exposure devices 324Y, 324M, 324C and 324K, the electrical charge of the negative polarity is removed so that electrostatic latent images are formed.

In addition, in the developing devices 325Y, 325M, 325C and 325K, developing material including toner and magnetic carrier are housed. The magnetic carrier is a charge giving particle which charges the toner by a friction between the toner and the magnetic carrier, and is a magnetic particle. In the developing devices 325Y, 325M, 325C and 325K, the developing material is mixed up and by this mix up, the toner and the magnetic carrier are rubbed with each other. By the friction, the toner is charged electrically with the negative polarity, and the magnetic carrier is charged electrically with the positive polarity. For this reason, in the image developing devices 325Y, 325M, 325C and 325K, the toner and the magnetic carrier are electrically absorbed with each other to be easily mixed up.

In addition, the developing devices 325Y, 325M, 325C and 325K include a developing roll which includes a magnet roll with a columnar form, and a sleeve with a cylindrical form which rotatably surrounds an external circumference around the magnet roll, although illustration of them are omitted. The developing roll rotates with holding the developing material by absorbing the magnetic carrier on a surface of the sleeve with a magnetic force of the magnet roll, so as to carry the developing material to a developing area formed between the photoreceptor rolls 321Y, 321M, 321C and 321K. The toner in the developing material which has been carried to the developing area are detached from the magnetic carrier by an electrical field generated between the electrostatic latent images formed on the surfaces of the photoreceptor rolls 321Y, 321M, 321C and 321K and the developing roll to attach with the electrostatic latent images. Thus, the electrostatic latent images formed on the surfaces of the photoreceptor rolls 321Y, 321M, 321C and 321K is developed by the toner.

The respective color toner images with the negative polarity attached to the respective electrostatic latent images are drawn electrostatically to a side of the intermediate transfer belt 31 by the primary transfer rolls 322Y, 322M, 322C and 332K to which currents with the positive polarity opposite to the polarity of the toner which forms the toner image are applied. Thus, the toner image is transferred to the surface of the intermediate transfer belt. In the image forming apparatus 1, application of the transfer current to the primary transfer rolls 322Y, 322M, 322C and 322K is controlled by the control section 2. In addition, the control section 2 switches application of two kinds of transferring currents, although a determination reference of the switching will be described later in detail.

The toner images transferred to the intermediate transfer belt 31 are, similarly to the primary transfer, drawn static electrically to a side of the recording sheet by the secondary transfer roll 33 to which a voltage with the negative polarity opposite to the polarity of the toner image is applied. Thus, the toner images which are transferred to the intermediate transfer belt 31 are transferred to the recording sheet. In the image forming apparatus 1, application of the transfer voltage to the secondary transfer roll 33 is also controlled by the control section 2, and the control section 2 applies the applying voltage with only one reference.

Next, density control of the toner image using the optical sensor section 6 in the image forming apparatus 1 will be explained.

In the image forming apparatus 1, in order to check whether or not a toner image having target densities in the respective main bodies 32Y, 32M, 32C and 32K, patches which are dummies of the toner images are formed for the respective main bodies 32Y, 32M, 32C and 32K. Then, those patches are transferred to the intermediate transfer belt 31, and densities of the patches are measured by using the optical sensor section 6.

Figure 2:
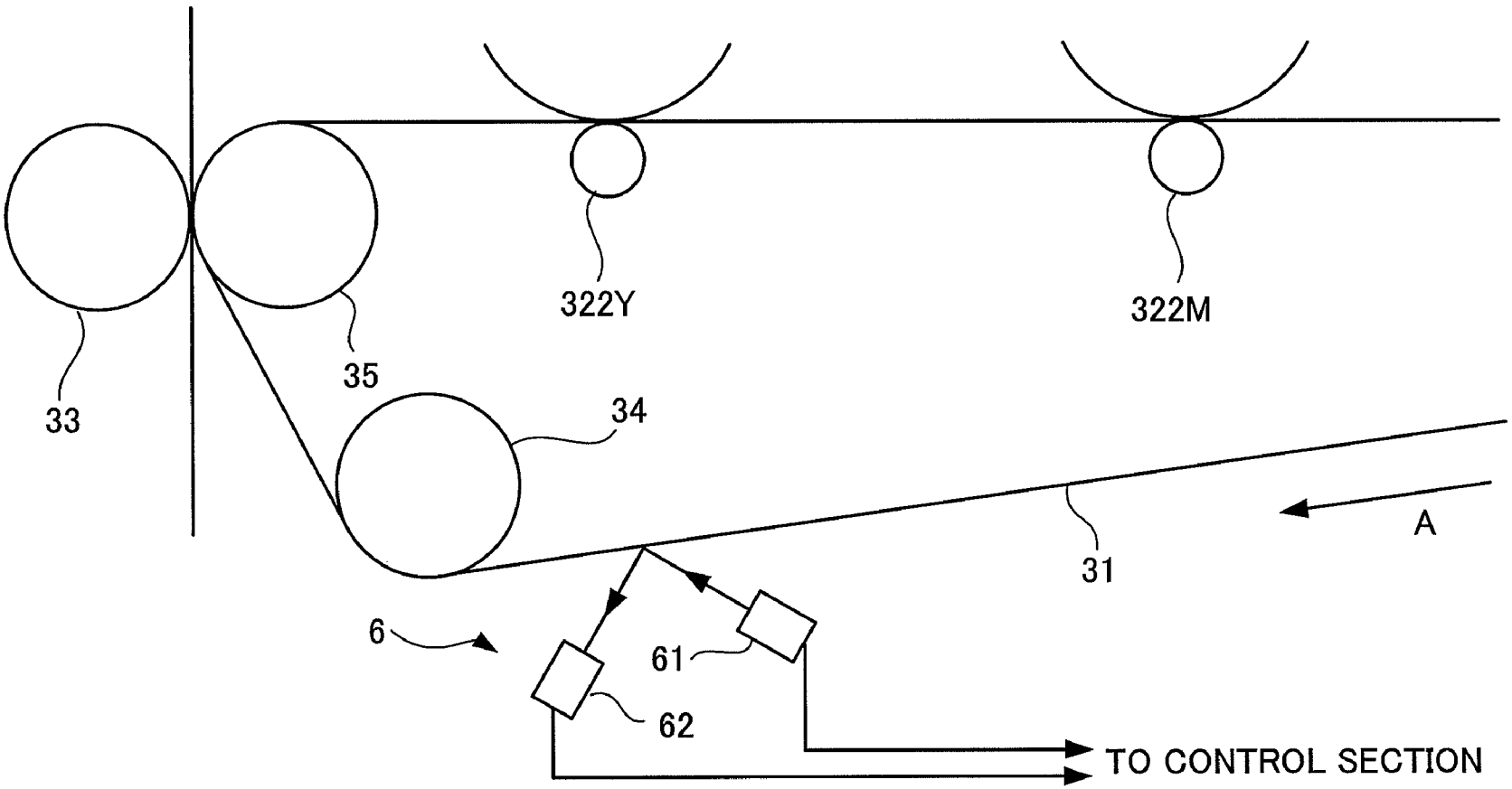
FIG. 2 is a schematic diagram of an optical sensor section.

FIG. 2 is a schematic diagram of an optical sensor section.

The optical sensor section 6 illustrated in FIG. 2 includes a light source 61 which emits light toward a portion of the intermediate transfer belt 31 which passes through between two of supporting rolls 34 and a light receiving sensor 62 which receives reflected light which is emitted from the light source 61 and reflected on the intermediate transfer belt side.

The light source 61 emits light on receipt of an instruction from the control section 2, and the light receiving sensor 62 outputs to the control section 2 a signal according to the amount of the received reflected light.

If the control section 2 determines that the patches having the target densities are not formed based on the signal from the light receiving sensor 62, the control section instructs individually the respective bodies 32Y, 32M, 32C and 32K to adjust respective density control parameters.

Here, in an image forming apparatus of a type in which a toner image formed by a static electrically charged toner is primarily transferred static electrically to a transfer accepting body such as an intermediate transfer belt, such as the image forming apparatus 1 according to the present exemplary embodiment, there occurs a case where unevenness occurs on a surface of the transfer accepting body, and the primary transfer is performed to a portion where the unevenness occurs. In particular, if a non-operation duration in a condition of a high temperature and a high humidity in a state where members which sandwich the transfer accepting body (in the present exemplary embodiment, the secondary transfer roll 33 and the facing roll 35 which sandwich the intermediate transfer belt 31) are not apart becomes long, a track sandwiched by the members remains as the unevenness in the transfer accepting body. If the primary transfer is performed to a portion where this unevenness occurs, "deletion (white space on a colored background)" by a transfer failure of the toner image in the portion where the unevenness occurs may be produced. It is conceivable that this is because the Coulomb's force to draw the toner to the transfer accepting body side is lowered due to the unevenness of the surface of the transfer accepting body.

And so, in the image forming apparatus 1, the optical sensor section 6 which is used to control the density of toner is used to detect the unevenness on the intermediate transfer belt, and also by the method which will be explained in the following, "the deletion (white space on a colored background)" by the unevenness is suppressed.

Figure 3:
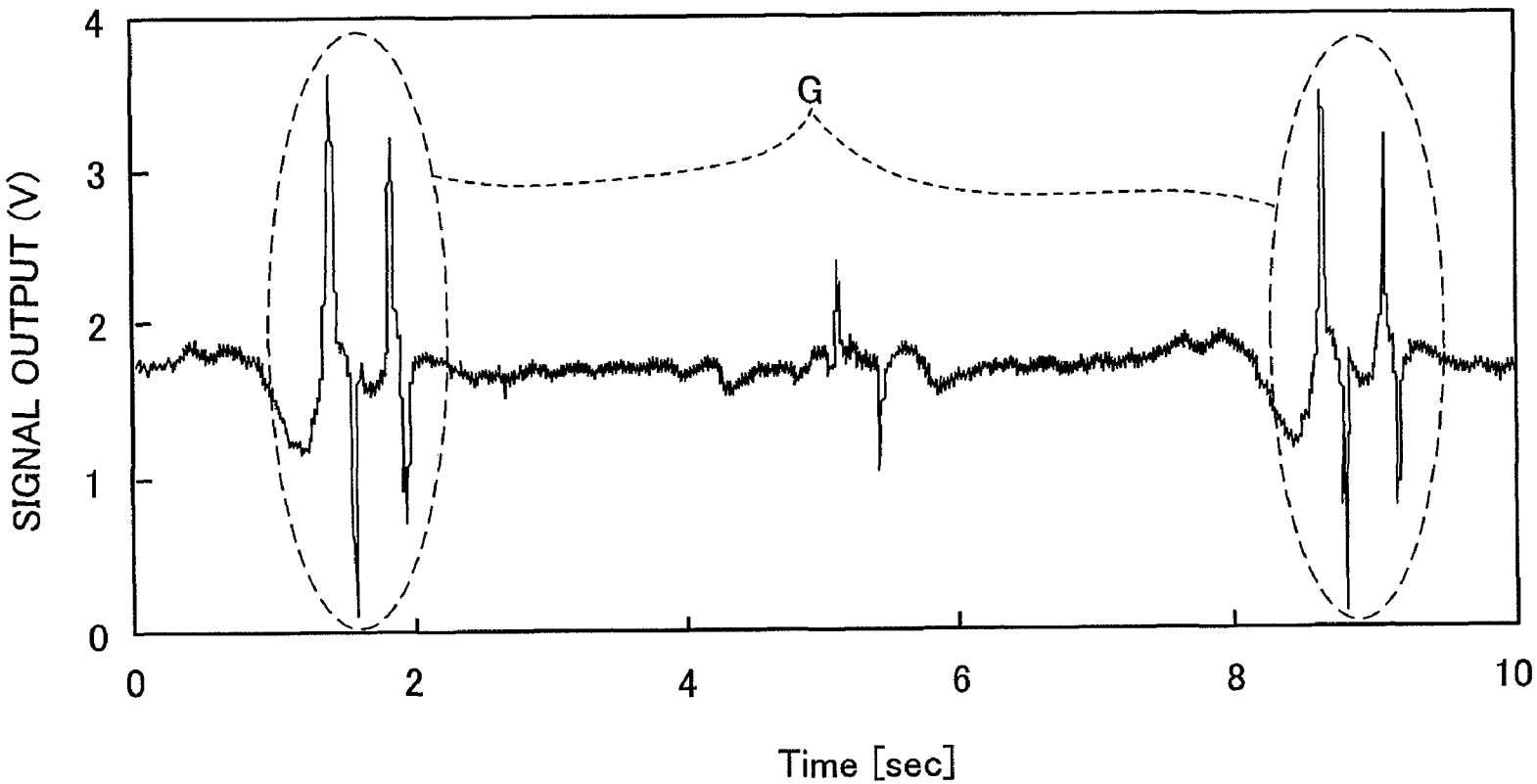
FIG. 3 is a graph illustrating an output signal from a light receiving sensor which receives a reflected light reflected from a surface of an intermediate transfer belt.

FIG. 3 is a graph illustrating an output signal from an light receiving sensor which receives a reflected light reflected from a surface of an intermediate transfer belt.

Firstly, in the image forming apparatus 1 according to the present invention, in order to check how an output signal from the light receiving sensor changes if there is the unevenness on the surface of the intermediate transfer belt 31, a condition is made in which a same portion of the intermediate transfer belt 31 remains sandwiched for a long time between the secondary transfer roll 33 and the facing roll 35 so that the unevenness occurs in the sandwiched portion. In FIG. 3, a change of a signal outputted from the light receiving sensor 62 when the intermediate transfer belt 31 is moved circularly without transferring the toner image to the intermediate transfer belt 31.

In areas G surrounded by the dashed line illustrated in FIG. 3, the signal which the light receiving sensor 62 outputs is illustrated when the light receiving sensor 62 receives reflected light reflected by the unevenness produced on the intermediate transfer belt 31. In the drawing, two same waveforms which are changed by large by the reflected light reflected by the same unevenness.

The control section 2 determines whether a change of the signal is larger or smaller than a predetermined threshold value which is set in advance, to determine a level of the unevenness. The optical sensor section 6 and the control section 2 collectively correspond to an example of the unevenness detection section and the image density control section.

In the image forming apparatus 1, as described above, both a position and a level of the unevenness on the intermediate transfer belt 31 are obtained simultaneously while checking the initial operation, and then a normal image forming operation is started. When the normal image forming operation is started, the control section 2 gives primarily an instruction to apply a lower current of two kinds of applying currents as an applying current to the primary transfer rolls 322Y, 322M, 322C and 322K. However, while a portion where the unevenness with a level exceeding a threshold value passes through between the primary transfer rolls 322Y, 322M, 322C and 322K and the respective photoreceptor rolls 321Y, 321M, 321C and 321K, the control section 2 gives an instruction to apply a larger current of the two kinds of applying currents. The control section 2 corresponds to an example of the current control section according to the exemplary embodiment of the invention.

Figure 4:
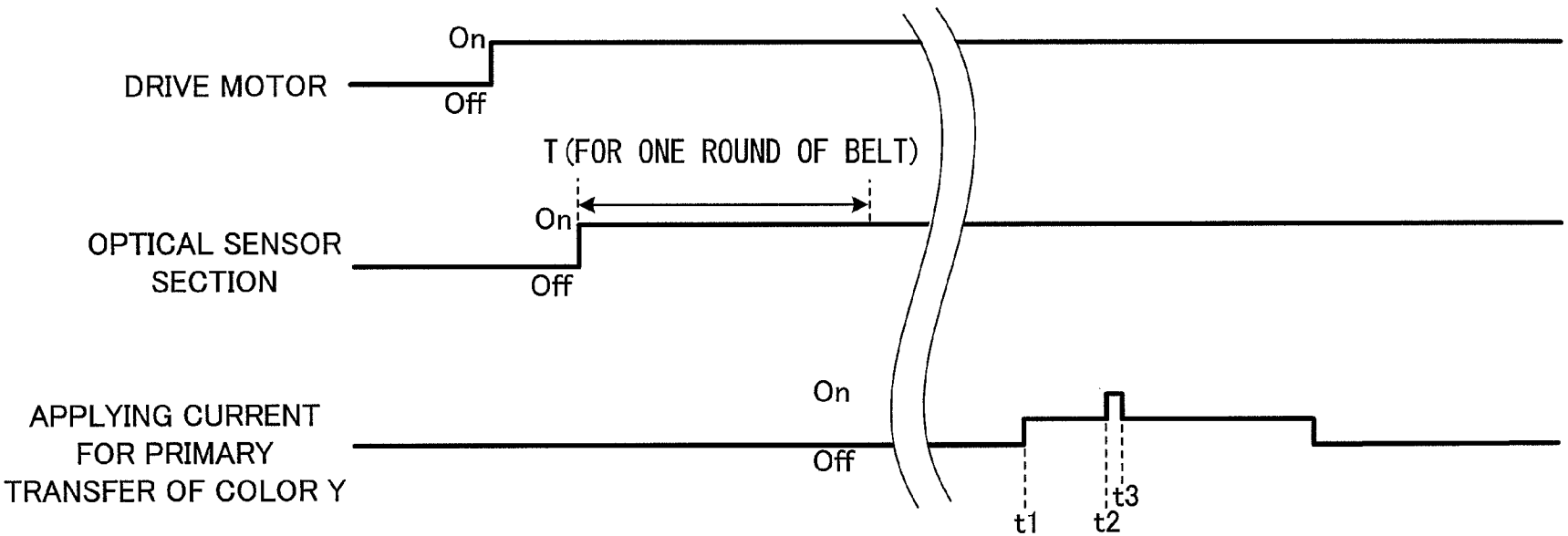
FIG. 4 is a timing chart of applying a current to each section at the time of image forming in the image forming apparatus according to the present exemplary embodiment.

FIG. 4 is a timing chart of applying a current to each section at the time of image forming in the image forming apparatus according to the present exemplary embodiment.

FIG. 4 illustrates, in an order from the top side, a timing chart of an ON instruction to a drive motor which drives each section, an ON instruction to the optical sensor section 6 and a current level which is applied to the primary transfer roll 322Y for yellow color.

FIG. 4 illustrates a state in which each section is firstly driven to be started, and subsequently, the optical sensor section 6 is started. In the control section 2, after a time duration T required for the intermediate transfer belt 31 to rotate one turn after the optical sensor section 6 is started elapses, to obtain both a position and a level of the unevenness on the intermediate transfer belt 31 completes.

FIG. 4 illustrates a state in which the applying current to the primary transfer roll 322Y is switched to a high current, compared to the applying current to portions which are prior to and subsequent to the portion from the time t2 to the time t3 when the only portion detected as portion where the unevenness exceeding a predetermined level occurs on the intermediate transfer belt 31 passes through between the primary transfer roll 322Y for Y color and the photoreceptor roll 321Y.

In the following, an example and comparative examples will be explained.

An example, a comparative example 1 and a comparative example 2 are performed in a modified apparatus in which a control section which is originally provided is removed from an image forming apparatus by FUJI XEROX Corporation, and is replaced with one which, like the control section 2 of the image forming apparatus 1 according to the exemplary embodiment 1, with respect to an instruction of applying a transfer current to the primary transfer roll, may switch the two kinds of apply currents. In addition, the control section of this modified apparatus may be performed by using an optical sensor device including a function of a kind similar to that of the optical sensor section of the image forming apparatus 1 according to the exemplary embodiment, which is originally provided with the image forming apparatus of the FUJI XEROX Corporation.

The example represents a case in which if a primary transfer is performed to a portion where the unevenness exceeding a certain level is detected on the intermediate transfer belt, a higher current of the two kinds of currents is applied as an applying current to that primary transfer roll while the portions passes through a nip area between primary transfer rolls and the photoreceptor rolls for respective colors.

The comparative example 1 represents a case where the applying current to the primary transfer roll is always the lower current.

The comparative example 2 represents a case where the applying current to the primary transfer roll is always the higher current.

For the evaluation, "A" represents good, "P" represents an acceptable range, and "F" represents a failure.

FIG. 5 is a diagram illustrating an experiment result.

FIG. 5 illustrates evaluations and determinations as to whether there is "deletion (white space on a colored background) by the unevenness" and "others" for each of the example, comparative example 1 and comparative example 2.

In the example, the evaluation as to "whether there is the deletion (white space on a colored background) by the unevenness" is "A", also as to "others" the evaluation is "A" without a failure, and "determination" is also "A."

In the comparative example 1, the evaluation as to "whether there is the deletion (white space on a colored background) by the unevenness by the unevenness" is "F", and although as to "others" the evaluation is "A" without a failure, the "determination" is "F."

In the comparative example 2, the evaluation as to "whether there is the deletion (white space on a colored background) " is "A", however, as to "others", the evaluation is "F" because the density becomes low by a re-transfer caused by reverse polarization of the toner, and the "determination" is also "F."

From the results above, it is confirmed that thanks to switching the applying currents to the primary transfer roll by the control section 2 of the present exemplary embodiment, it is possible to obtain both preventing the deletion (white space on a colored background) in the unevenness portion produced in the intermediate transfer belt 31 and securing transferability of an image as a whole.

Here, in the above-described exemplary embodiment, an example in which the light receiving sensor 62 of the optical sensor section 6 receives reflected light reflected on a front surface of the intermediate transfer belt 31 whose rear surface is not supported by the supporting roller 34 is explained. However, according to the image forming apparatus of the present invention, it is acceptable to receive reflection light reflected on a front surface of the intermediate transfer belt whose rear surface is supported by the supporting roll.

Figure 6:
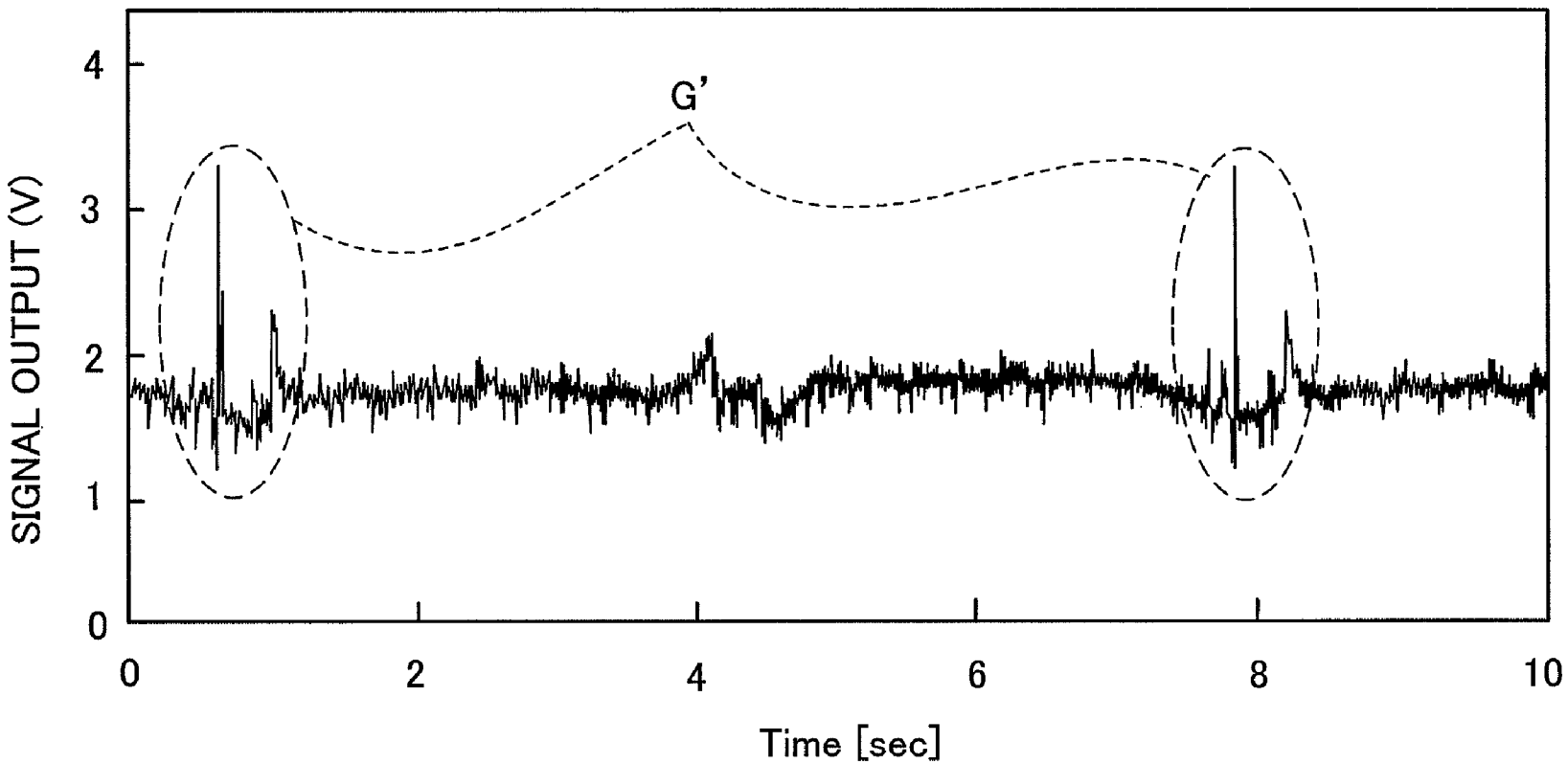
FIG. 6 is a graph illustrating a signal output obtained when reflected light reflected on a surface of a portion whose rear surface is supported by a supporting roll, of the intermediate transfer belt whose output signal is illustrated in FIG. 3, is received by the same light receiving sensor.

FIG. 6 is a graph illustrating a signal obtained when the same light receiving sensor receives reflected light reflected on a surface side of the same intermediate transfer belt while its rear surface is supported by a supporting roll whose signal output is illustrated in FIG. 3.

In areas G' surrounded by the dashed line in FIG. 6, a signal which changes larger than other portions even though the change is smaller than that indicated in the areas G surrounded by the dashed line in FIG. 3. A position and a level of the unevenness may be determined from the change of the signal indicated in the areas G'. A reason why the change of the signal indicated in the areas G' becomes smaller than that of the signal indicated in the areas G appears to be that the rear surface is supported by the supporting rolls 34 so that the unevenness may be spread.

Incidentally, in the above-described exemplary embodiment, an image forming apparatus in which a toner image is directly transferred to an intermediate transfer belt is exemplified. However, the present invention may be applied to an image forming apparatus of a type in which a toner image is transferred to a recording medium hold on the intermediate transfer belt.

Further, in the above-described exemplary embodiment, an image forming apparatus in which the unevenness on an intermediate transfer belt is detected by an optical sensor is exemplified. However, the unevenness detected section of the present invention is not limited to this. A contact sensor may be one which includes a contact member which are parallelly aligned to a width direction of the intermediate transfer belt and contacts a surface thereof.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image holding body on whose surface an image is formed and which holds the image on the surface;

an image forming section that forms a toner image composed of charged toner on the surface of the image holding body;

a transfer accepting body to which the toner image formed on the surface of the image holding body is transferred and moves circularly;

a transfer section that includes a current supplied member which is arranged at a position opposite to the image holding body with the transfer accepting body being between the current applied member and the image holding body and which is applied with a current whose polarity is opposite to a polarity of the toner image formed on the surface of the image holding body by the image forming section, and that transfers the toner image to the transfer accepting body by applying a current to the current applied member;

an unevenness detection section that detects an unevenness portion where unevenness occurs on a surface of the transfer accepting body; and a current control section that controls the current to be applied to the current applied member while the unevenness portion detected by the unevenness detection section passes through the position such that the current is larger than a current to be applied while a portion other than the unevenness portion of the transfer accepting body passes through the position.

2. The image forming apparatus according to claim 1, wherein the transfer accepting body is an endless belt in a loop form and a belt form that is put around a plurality of rollers, and the unevenness detection section detects the unevenness portion of the transfer accepting body at an uncontact place avoiding a place where the transfer accepting body and the plurality of rollers contact with each other.

3. The image forming apparatus according to claim 1, further comprising the image density control section that includes a light source which emits light toward the transfer accepting body and a light receiving sensor which receives reflected light which is emitted from the light source and reflected on the surface of the transfer accepting body, and outputs a received-light signal according to the reflected light, and that controls the image density of the toner image based on the received-light signal outputted from the light receiving sensor, wherein the unevenness detection section detects the unevenness on the transfer accepting body based on a change of the received-light signal outputted from the light receiving sensor which receives the reflection light reflected on the surface of the transfer accepting body.

4. The image forming apparatus according to claim 2, further comprising the image density control section that includes a light source which emits light toward the transfer accepting body and a light receiving sensor which receives reflected light which is emitted from the light source and reflected on the surface of the transfer accepting body, and outputs a received-light signal according to the reflected light, and that controls the image density of the toner image based on the received-light signal outputted from the light receiving sensor, wherein the unevenness detection section detects the unevenness on the transfer accepting body based on a change of the received-light signal outputted from the light receiving sensor which receives the reflection light reflected on the surface of the transfer accepting body.

5. An image forming apparatus, comprising:

an image holding body on whose surface an image is formed and which holds the image on the surface;

an image forming section that forms a toner image composed of charged toner on the surface of the image holding body;

a transfer accepting body to which the toner image formed on the surface of the image holding body is transferred and moves circularly;

a transfer section that includes a current supplied member which is arranged at a position opposite to the image holding body with the transfer accepting body being between the current applied member and the image holding body and which is applied with a current whose polarity is opposite to a polarity of the toner image formed on the surface of the image holding body by the image forming section, and that transfers the toner image to the transfer accepting body by applying a current to the current applied member; and a current control section that controls the current to be applied to the current applied member, such that the current to be applied when an unevenness portion on the surface of the transfer accepting body passes through a position is larger than a current to be applied when a portion other than the unevenness portion of the transfer accepting body passes through the position.

6. The image forming apparatus of claim 1, the unevenness detection section comprising an optical sensor including a light source that emits light toward a surface of the transfer accepting body and a light receiving sensor that receives reflected light from the transfer accepting body.

7. The image forming apparatus of claim 1, wherein the transfer accepting body moves circularly without receiving transfer of a toner image during check of initial operation of the image forming apparatus which is carried out before the image forming section starts the formation of the toner image, and the unevenness detection section detects the unevenness portion existing on the surface of the transfer accepting body during the check of the initial operation of the image forming apparatus.

* * * * *